United States Patent [19]

Jones

[11] 4,259,911

[45] Apr. 7, 1981

[54] FLUIDIZED BED BOILER FEED SYSTEM

[75] Inventor: Brian C. Jones, Windsor, Conn.

[73] Assignee: Combustion Engineering, Inc., Windsor, Conn.

[21] Appl. No.: 50,721

[22] Filed: Jun. 21, 1979

[51] Int. Cl.[3] ..... F22B 1/00

[52] U.S. Cl. ..... 110/245; 110/263; 110/106; 122/4 D

[58] Field of Search ..... 110/263, 264, 232, 347, 110/243-245, 101 R, 106; 122/4 D

[56] References Cited

U.S. PATENT DOCUMENTS

| | | | |
|---|---|---|---|
| 2,638,684 | 5/1953 | Jukkola | 110/264 |
| 2,716,002 | 8/1955 | Craig | 110/106 |
| 2,917,011 | 12/1959 | Korner | 110/264 |
| 3,763,830 | 10/1973 | Robinson et al. | 110/264 |
| 4,017,253 | 4/1977 | Wielang et al. | 110/245 |
| 4,085,707 | 4/1978 | Moss | 110/263 |
| 4,103,646 | 8/1978 | Yerushalmi et al. | 110/263 |
| 4,184,456 | 1/1980 | Taylor et al. | 110/245 |

*Primary Examiner*—Henry C. Yuen

*Attorney, Agent, or Firm*—Wayne H. Lang

[57] ABSTRACT

A fluidized bed boiler feed system for the combustion of pulverized coal. Coal is first screened to separate large from small particles. Large particles of coal are fed directly to the top of the fluidized bed while fine particles are first mixed with recycled char, preheated, and then fed into the interior of the fluidized bed to promote char burnout and to avoid elutriation and carryover.

3 Claims, 2 Drawing Figures

FLUIDIZED BED BOILER FEED SYSTEM

The government of the United States of America has the rights in this invention pursuant to Contract No. EX-76-C-01-2473 awarded by the U.S. Energy Research and Development Administration.

BACKGROUND OF THE INVENTION

This invention relates to fluidized bed reactor systems used for the combustion of crushed coal in industrial or utility type applcations. Presently used fluidized bed systems transport crushed coal and limestone to the boiler with transport air in a condition known as dilute phase pneumatic transport. The transport air upon entering the bed has been shown to form a significant void extending from the feed point upward into the bed. This void region is characterized by severe channeling and spounting of solids inasmuch as when crushed coal enters the bed, volatiles and feed fines become entrained in the spout, then elutriated and exhausted from the system. This situation contributes to lower combustion efficiency since the fines are not able to burn out in the bed but are rapidly extinguished after they become elutriated. However, combustion of volatiles is promoted above the bed so as to make it difficult to maintain desired bed temperatures.

A partial solution to the problems that accompany fluidized bed combustion is overcome by feeding crushed coal only in an overbed arrangement. Here the transport air is released above the bed whereby it will not affect the bed dynamics. However, this arrangement is not efficient since the feed coal must be double screened to first remove the fines, for if the fines fall freely upon the top of the bed they are rapidly elutriated and not used for combustion in the bed.

DESCRIPTION OF THE PRIOR ART

Various patents have been granted for fluidized bed type reactors in which a bed of discrete material comprised of fuel, limestone and inert particles may be fluidized by passing a stream of combustion air upward therethrough. One patent which illustrates such a system is U.S. Pat. No. 3,763,830 of Robinson et al granted on Oct. 9, 1973. In this patent, a housing containing a bed of discrete material is provided with a quantity of fuel and limestone by a pneumatic feed system in accordance with the current state of the art.

In most instances, the fuel and limestone are supplied directly into the bed. In coal fired systems, many coal fines escape from the bed as unburned coal and char to become elutriated before they are completely burned. Present practice calls for them to be collected and then reinjected back into the bed for additional burning. However, even then the fines must be reactive enough to permit burnout in the residence time they are in the bed, before they are again elutriated. Current operating experience has shown that some coal chars exhibit a low reactivity at fluidized bed temperatures, even as high as 1550° F. In addition, customary pneumatic reinjection creates air channeling through the bed so the char is again frequently elutriated before it is completely burned in the bed.

SUMMARY OF THE INVENTION

This invention is therefore directed to a fluidized bed type apparatus in which a supply of coarsely crushed coal and limestone or other sulfur-acceptor such as dolomite is continuously conveyed to the top of a fluidized bed by an oerbed type feeder. A supply of coal fines is however mixed with recycle coal char before it is conveyed into the bed by means of a fuel pump in a dense phase pneumatic transport. Complete burn-out of the fines and coal char is promoted by their being preheated in the transport line before they are discharged into the bed. Moreover, complete burning is enhanced by the agglomeration of the coal fines to the extent that they are transformed into larger fused particles. Since the particle size of the fines is increased, their residence time in the bed is also increased and the complete combustion of the char and coal fines is effectively enhanced. Moreover, the agglomerated coal fines will de-volatilize at the reinjection point, thus causing a local hot spot that will even more promote complete combustion of the char and coal fines.

DESCRIPTION OF THE PREFERRED EMBODIMENTS

Figure 1:
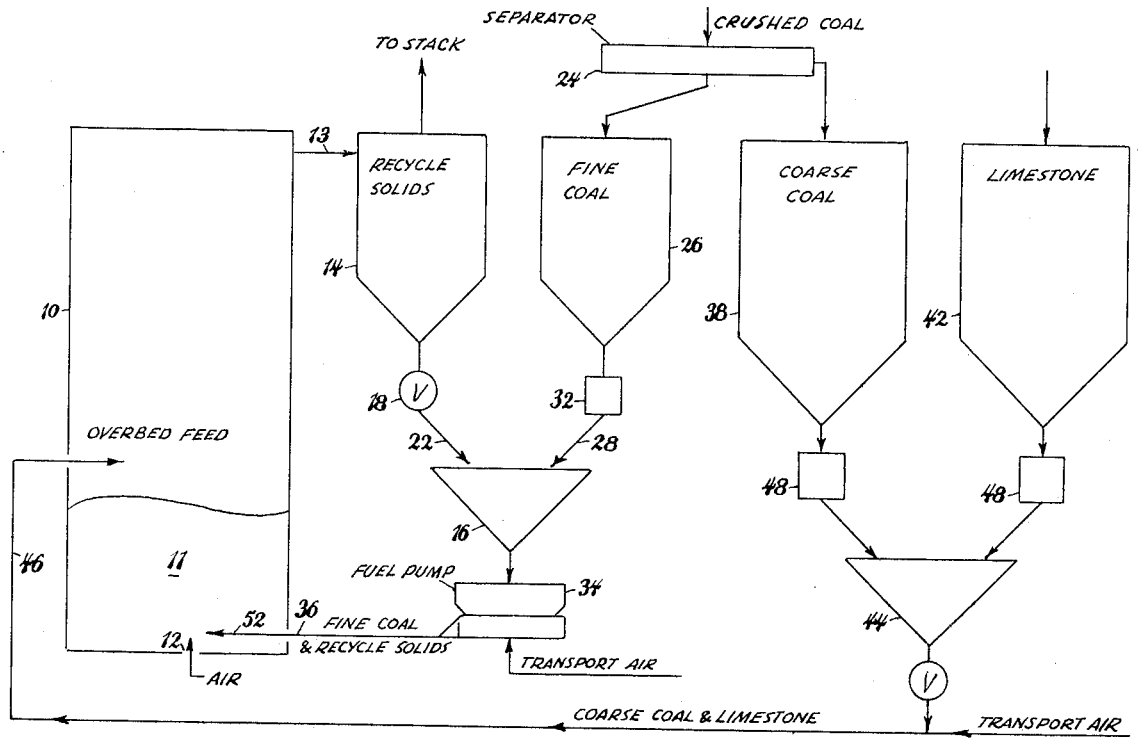
FIG. 1 is a schematic diagram of a fluid bed type system having a fuel injection arrangement disposed according to this invention.
Figure 2:
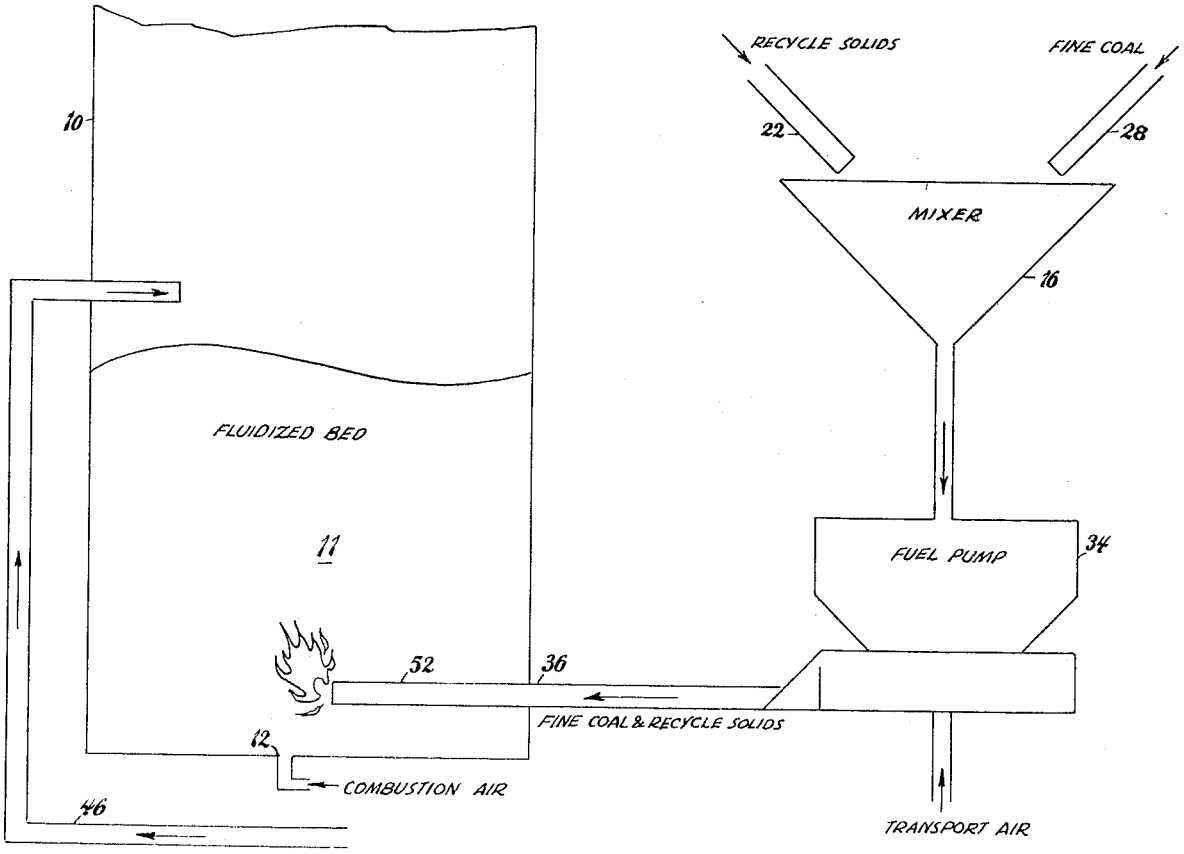
FIG. 2 is an enlarged vertical section that shows more particularly the details of the fluid bed.

Referring to FIG. 1 there is shown a furnace 10 enclosing a fluidized bed 11 of crushed coal and limestone. The term limestone as used herein and in the claims is intended to include other sulfur acceptors such as dolomite or even synthetic acceptors. An inlet 12 is provided for combustion air and an outlet 13 at the upper end of the furnace directs combustion gases and entrained particulate matter to an air cleaner 14 from which the clean effluent is exhausted to the atmosphere while particulate recycle solids removed from the combustion gases are directed to a mixer 16 through a valve 18 in passageway 22 therebetween.

A new supply of crushed coal is suppled to a screener or other separator 24 where coal fines are separated from the coarsely crushed coal. By way of example, the supply of crushed coal may be sized to $\frac{1}{4}'' \times 0$. The coarse coal fraction would then be separated as $\frac{1}{4}'' \times \frac{1}{8}''$, and the coal fines to $\frac{1}{8}'' \times 0$. The coal fines are then supplied to a silo 26 and then mixed with the recycle solids in mixer 16. A duct 28 between the silo 26 and the mixer 16 includes a conventional weigh feeder 32 that allows coal fines to pass therethrough according to predetermined limits. Thus the mixer 16 will contain a mixture of coal fines and recycle solids deemed to have optimum qualities for agglomeration and combustion when they are reduced to a dense phase and fed into the fluidized bed 11 by a pump 34 in passageway 36. Dilute phase and dense pneumatic transport are terms commonly applied in solids conveying systems. Dilute phase pneumatic transport is characterized by the flowing of solids in a highly voided state. Individual particles are conveyed by being carried along in a stream of transport air. Dense phase pneumatic transport ischaraterized by the flowing of the solids in a high bulk density mixture such that the particles are conveyed by the pushing action of the particles against each other. The driving force is generally provided by mechanical means such as a feed screw or fuel pump.

Dense phase pneumatic transport requires less transport air, thereby reducing spouting and elutriation at the point of injection within the bed. Moreover, dense phase pneumatic transport provides a longer solids residence time and better solids contacting in the transport line cmpared to dilute phase transport, to effectively enhance solids reheating and coal fines agglomeration.

The coarsely crushed coal from separator 24 is fed to a storage silo 38 while crushed limestone is supplied to a storge silo 42. The coarsely crushed coal and the limestone are mixed together in a mixer 44 and supplied to an air supply traversing line 46. Suitable weigh feeders 48 intermediate their respective storage silos 38 and 42 control the supply of coal and limestone to mixer 44 to produce the optimum proportion of coal and limestone for overbed supply to the fluidized bed 11.

The coarse coal and limestone are therefore transported to the housing 10 and discharged over the top of the fluidized bed 11 by any of several conventional arrangements, while the fine particles of coal, together with the fine recycle solids, are supplied to the interior of the fluidized bed to promote burn-out of the coal fines and char.

The recycle solids and coal fines are suitably mixed and supplied by line 36 to the fluidized bed 11. The transport line 36 includes an extension 52 that extends a sufficient distance into the heated bed to allow the particulate matter traversing extension 52 to be preheated therein before being exhausted therefrom into the bed. The high temperature of the bed thus causes some of the fines to attain a high temperature before they are injected into the bed. As the dense phase fines are injected into the hot fluidized bed, they quickly burn out because of the increased reactivity caused by the higher reheat temperatures and because of the reduced incidence of voids that cause spouting and elutriation. Moreover, some of the fines will agglomerate with the recycle solids in the transport line forming larger fused particles that have an increased residence time in the bed, thereby enhancing more complete combustion. Furthermore, the coal fines will de-volatilize at the reinjection point and burn off rapidly to form a local hot spot around each particle to promote a more rapid and complete burn-out.

I claim:

1. A combustion system including a furnace housing enclosing a fluidized bed of coal and limestone that burns to form gaseous products of combustion and residual char, an outlet in said furnace for the exhaust of the products of combustion and said residual char entrained therein, means separating the products of combustion from said char, a source of crushed coal including coarse and fine particles, means separating the coarse particles of coal from the fine particles, means mixing the residual char with the fine particles of coal, means supplying the coarse particles of coal to the top of the fluidized bed in the furnace, a source of transport air, a transport line adapted to supply the transport air to said housing, an inlet in said housing adapted to receive the transport air and exhaust it into the fluidized bed, means supplying a mixture of fine particles of coal and residual char to the transport air whereby they are simultaneously exhausted into the fluidized bed, and means interposed in said transport line intermediate the mixing means and the furnace housing adapted to reduce the fines in the transport air to a dense phase.

2. A combustion system as defined in claim 1 including means that preheats and effects the agglomeration of the coal fines and residual char in said transport line before they are exhausted into the fluidized bed.

3. A combustion system as define in claim 2 wherein the tubular extension contiguous with the inlet duct is comprised of heat resistant alloy.

* * * * *